US007648136B2

(12) United States Patent
Terao et al.

(10) Patent No.: US 7,648,136 B2
(45) Date of Patent: Jan. 19, 2010

(54) SHEET POST-PROCESS APPARATUS

(75) Inventors: Yasunobu Terao, Tagata-gun (JP); Mikio Yamamoto, Tagata-gun (JP); Tomomi Iijima, Mishimi (JP); Reiji Murakami, Yokohama (JP); Hiroyuki Taki, Tagata-gun (JP); Tokihiko Ise, Tagata-gun (JP); Hajime Yamamoto, Mishima (JP); Yoshiaki Sugizaki, Sunto-gun (JP); Katsuya Sasahara, Izu (JP); Chiaki Iizuka, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/822,611

(22) Filed: Jul. 9, 2007

(65) Prior Publication Data

US 2007/0252320 A1 Nov. 1, 2007

Related U.S. Application Data

(63) Continuation of application No. 11/008,567, filed on Dec. 10, 2004, now Pat. No. 7,300,045.

(30) Foreign Application Priority Data

| | | |
|---|---|---|
| Sep. 28, 2004 | (JP) | 2004-281769 |
| Sep. 28, 2004 | (JP) | 2004-281770 |
| Sep. 28, 2004 | (JP) | 2004-281771 |
| Sep. 28, 2004 | (JP) | 2004-281772 |
| Sep. 28, 2004 | (JP) | 2004-281773 |
| Sep. 28, 2004 | (JP) | 2004-281774 |
| Sep. 28, 2004 | (JP) | 2004-281775 |
| Sep. 28, 2004 | (JP) | 2004-281776 |
| Sep. 28, 2004 | (JP) | 2004-281777 |
| Sep. 28, 2004 | (JP) | 2004-281778 |
| Sep. 28, 2004 | (JP) | 2004-281779 |
| Sep. 28, 2004 | (JP) | 2004-281780 |
| Sep. 28, 2004 | (JP) | 2004-281781 |
| Sep. 28, 2004 | (JP) | 2004-281782 |
| Sep. 28, 2004 | (JP) | 2004-281783 |
| Sep. 28, 2004 | (JP) | 2004-281784 |
| Sep. 28, 2004 | (JP) | 2004-282203 |
| Sep. 28, 2004 | (JP) | 2004-282204 |
| Sep. 28, 2004 | (JP) | 2004-282205 |
| Sep. 28, 2004 | (JP) | 2004-282206 |
| Sep. 28, 2004 | (JP) | 2004-282207 |
| Sep. 28, 2004 | (JP) | 2004-282208 |
| Sep. 28, 2004 | (JP) | 2004-282209 |
| Sep. 28, 2004 | (JP) | 2004-282210 |
| Sep. 28, 2004 | (JP) | 2004-282211 |
| Sep. 28, 2004 | (JP) | 2004-282212 |
| Sep. 28, 2004 | (JP) | 2004-282213 |
| Sep. 28, 2004 | (JP) | 2004-282214 |

(51) Int. Cl.
*B65H 29/34* (2006.01)

(52) U.S. Cl. ..... 271/189; 271/177; 271/180; 270/58.11

(58) Field of Classification Search ..... 270/58.08, 270/58.11, 58.12, 58.14, 58.18, 58.16; 399/410; 271/189, 190, 191, 192, 177, 306, 178, 180
See application file for complete search history.

(56) References Cited

U.S. PATENT DOCUMENTS

| | | | | |
|---|---|---|---|---|
| 4,473,425 | A | 9/1984 | Baughman et al. | |
| 4,511,297 | A | 4/1985 | Wilson et al. | |
| 4,611,741 | A | 9/1986 | Wilson | |
| 4,667,208 | A | 5/1987 | Shiraki et al. | |
| 4,794,859 | A | 1/1989 | Huseby et al. | |
| 4,849,796 | A | 7/1989 | Murakami | |
| 4,878,656 | A | 11/1989 | Honjo et al. | |
| 4,898,374 | A | 2/1990 | Vermaat | |
| 4,917,366 | A | 4/1990 | Murakami et al. | |
| 5,020,784 | A | 6/1991 | Asami et al. | |
| 5,021,837 | A | 6/1991 | Uto et al. | |
| 5,071,112 | A * | 12/1991 | Signoretto | 271/180 |
| 5,098,074 | A | 3/1992 | Mandel et al. | |
| 5,112,034 | A | 5/1992 | Uto et al. | |
| 5,282,611 | A | 2/1994 | Ueda et al. | |
| 5,285,249 | A | 2/1994 | Mahoney | |

| | | | |
|---|---|---|---|
| 5,289,251 | A | 2/1994 | Mandel et al. |
| 5,337,134 | A | 8/1994 | Sato et al. |
| 5,370,384 | A | 12/1994 | Romanowski |
| 5,418,606 | A | 5/1995 | Kikuchi et al. |
| 5,435,544 | A | 7/1995 | Mandel |
| 5,449,157 | A | 9/1995 | Kawano et al. |
| 5,451,037 | A | 9/1995 | Lundstrom |
| 5,590,871 | A | 1/1997 | Okabe et al. |
| 5,622,359 | A | 4/1997 | Kawano et al. |
| 5,628,502 | A | 5/1997 | Amarakoon |
| 5,640,232 | A | 6/1997 | Miyake et al. |
| 5,676,517 | A | 10/1997 | Lotz |
| 5,709,376 | A | 1/1998 | Ushirogata |
| 5,767,884 | A | 6/1998 | Bortolotti et al. |
| 5,934,140 | A | 8/1999 | Jackson et al. |
| 5,961,274 | A | 10/1999 | Bors |
| 5,971,384 | A | 10/1999 | Asao |
| 6,022,011 | A | 2/2000 | Hirose |
| 6,065,747 | A | 5/2000 | Khovaylo et al. |
| 6,092,948 | A | 7/2000 | Altfather |
| 6,102,385 | A | 8/2000 | Wakamatsu et al. |
| 6,120,020 | A | 9/2000 | Asao |
| 6,142,461 | A | 11/2000 | Asao et al. |
| 6,145,828 | A | 11/2000 | Arai |
| 6,146,085 | A | 11/2000 | Namba et al. |
| 6,179,287 | B1 | 1/2001 | Watanabe et al. |
| 6,220,592 | B1 | 4/2001 | Watanabe et al. |
| 6,231,039 | B1 | 5/2001 | Chung |
| 6,231,045 | B1 | 5/2001 | Yamada et al. |
| 6,322,070 | B2 | 11/2001 | Yamada et al. |
| 6,330,999 | B2 | 12/2001 | Coombs et al. |
| 6,336,630 | B1 | 1/2002 | Holtman et al. |
| 6,354,059 | B1 | 3/2002 | Yoshie et al. |
| 6,357,753 | B1 | 3/2002 | Yamasaki et al. |
| 6,371,472 | B1 | 4/2002 | Miyake et al. |
| 6,416,052 | B2 | 7/2002 | Yamada et al. |
| 6,450,934 | B1 | 9/2002 | Coombs |
| 6,505,829 | B2 | 1/2003 | Kawata |
| 6,550,763 | B2 * | 4/2003 | Gordon et al. ..... 271/189 |
| 6,581,922 | B2 | 6/2003 | Kuwata et al. |
| 6,600,885 | B2 | 7/2003 | Kida |
| 6,631,896 | B2 | 10/2003 | Yamada et al. |
| 6,641,129 | B2 | 11/2003 | Ogita et al. |
| 6,659,455 | B2 | 12/2003 | Endo et al. |
| 6,671,492 | B2 | 12/2003 | Mimura et al. |
| 6,674,983 | B2 | 1/2004 | Enomoto et al. |
| 6,698,744 | B2 | 3/2004 | Yamada et al. |
| 6,712,349 | B2 | 3/2004 | Watanabe |
| 6,722,646 | B2 * | 4/2004 | Sekiyama et al. ..... 270/58.09 |
| 6,722,650 | B1 | 4/2004 | Abbata et al. |
| 6,733,006 | B2 | 5/2004 | Kobayashi et al. |
| 6,733,007 | B2 | 5/2004 | Sekiyama et al. |
| 6,767,012 | B2 | 7/2004 | Sasamoto |
| 6,819,906 | B1 | 11/2004 | Herrmann et al. |
| 6,824,128 | B2 | 11/2004 | Nagata et al. |
| 6,848,685 | B2 | 2/2005 | Katsuyama |
| 6,871,042 | B2 | 3/2005 | Nemura et al. |
| 6,910,686 | B2 | 6/2005 | Awano |
| 6,928,259 | B2 | 8/2005 | Sakuma |
| 6,988,728 | B2 | 1/2006 | Kida |
| 7,104,538 | B1 | 9/2006 | Kimura et al. |
| 7,124,200 | B2 | 10/2006 | Sato et al. |
| 2002/0038379 | A1 | 3/2002 | Sato et al. |
| 2002/0047233 | A1 | 4/2002 | Coombs et al. |
| 2002/0053766 | A1 | 5/2002 | Kubota |
| 2002/0074708 | A1 | 6/2002 | Nagata et al. |
| 2002/0163119 | A1 | 11/2002 | Kawata |
| 2003/0057625 | A1 | 3/2003 | Kuwata et al. |
| 2003/0155705 | A1 | 8/2003 | Sekiyama et al. |
| 2003/0214090 | A1 | 11/2003 | Kato et al. |
| 2004/0032073 | A1 | 2/2004 | Sasamoto |
| 2004/0113348 | A1 | 6/2004 | Awano |
| 2004/0126163 | A1 | 7/2004 | Asami et al. |
| 2004/0181308 | A1 | 9/2004 | Hayashi et al. |
| 2005/0000336 | A1 | 1/2005 | Hattori et al. |
| 2006/0067766 | A1 | 3/2006 | Terao et al. |

FOREIGN PATENT DOCUMENTS

| | | | |
|---|---|---|---|
| JP | 56-006553 | A | 1/1981 |
| JP | 60-014547 | A | 1/1985 |
| JP | 60-023250 | A | 2/1985 |
| JP | 61-078162 | U | 5/1986 |
| JP | 61-108588 | A | 5/1986 |
| JP | 61-021481 | Y2 | 6/1986 |
| JP | 61-166470 | A | 7/1986 |
| JP | 62-008965 | A | 1/1987 |
| JP | 62-229126 | A | 10/1987 |
| JP | 63-035756 | U | 3/1988 |
| JP | 63-154578 | A | 6/1988 |
| JP | 63-180673 | A | 7/1988 |
| JP | 63-180660 | U | 11/1988 |
| JP | 01-181352 | A | 7/1989 |
| JP | 02-055369 | A | 2/1990 |
| JP | 03-088667 | A | 4/1991 |
| JP | 04-125248 | A | 4/1992 |
| JP | 04-079857 | U | 7/1992 |
| JP | 04-312894 | A | 11/1992 |
| JP | 04-354756 | A | 12/1992 |
| JP | 05-016569 | A | 1/1993 |
| JP | 05-238103 | A | 9/1993 |
| JP | 06-064815 | A | 3/1994 |
| JP | 06-083132 | A | 3/1994 |
| JP | 06-051970 | U | 7/1994 |
| JP | 06-094324 | B2 | 11/1994 |
| JP | 2001-175130 | A | 12/1994 |
| JP | 08-026558 | A | 1/1996 |
| JP | 08-217321 | A | 8/1996 |
| JP | 08-259073 | A | 10/1996 |
| JP | 02-583594 | B2 | 11/1996 |
| JP | 08-316973 | A | 11/1996 |
| JP | 09-124216 | A | 5/1997 |
| JP | 09-216772 | A | 8/1997 |
| JP | 09-309659 | A | 12/1997 |
| JP | 10-095563 | A | 4/1998 |
| JP | 10-279160 | A | 10/1998 |
| JP | 10-279169 | A | 10/1998 |
| JP | 10-313328 | A | 11/1998 |
| JP | 10-316299 | A | 12/1998 |
| JP | 10-324449 | A | 12/1998 |
| JP | 11-0117786 | A | 1/1999 |
| JP | 11-043257 | A | 2/1999 |
| JP | 11-147641 | A | 6/1999 |
| JP | 11-157724 | A | 6/1999 |
| JP | 11-157729 | A | 6/1999 |
| JP | 11-208967 | A | 8/1999 |
| JP | 11-231753 | A | 8/1999 |
| JP | 11-301912 | A | 11/1999 |
| JP | 2000-095420 | A | 4/2000 |
| JP | 2000-105703 | A | 4/2000 |
| JP | 2000-159414 | A | 6/2000 |
| JP | 2001-048411 | A | 2/2001 |
| JP | 2001-0072321 | A | 3/2001 |
| JP | 2001-089009 | A | 4/2001 |
| JP | 2001-106423 | A | 4/2001 |
| JP | 2001-125459 | A | 5/2001 |
| JP | 2001-240304 | A | 9/2001 |
| JP | 2001-316029 | A | 11/2001 |
| JP | 2002-060118 | A | 2/2002 |
| JP | 2002-111723 | A | 4/2002 |
| JP | 2002-308509 | A | 10/2002 |
| JP | 2002-321862 | A | 11/2002 |
| JP | 2002-362825 | A | 12/2002 |
| JP | 2003-002511 | A | 1/2003 |
| JP | 2003-081517 | A | 3/2003 |
| JP | 2003-128323 | A | 5/2003 |

| | | | |
|---|---|---|---|
| JP | 2003-167843 | A | 6/2003 |
| JP | 2003-171057 | A | 6/2003 |
| JP | 2003-192210 | A | 7/2003 |
| JP | 2003-246536 | A | 9/2003 |
| JP | 2003-335450 | A | 11/2003 |
| JP | 2004-083261 | A | 3/2004 |
| JP | 2004-142863 | A | 5/2004 |
| JP | 2004-142868 | A | 5/2004 |
| JP | 4164058 | B2 | 8/2008 |

OTHER PUBLICATIONS

Y. Terao et al., Notice of Allowance and Fee(s) Due, U.S. Appl. No. 11/085,248, filed Aug. 16, 2007, 8 pages.
Y. Terao et al., U.S. PTO Office Action, U.S. Appl. No. 11/085,257, filed Jul. 16, 2007, 12 pgs.
U.S. Appl. No. 11/008,122, filed Dec. 10, 2004, Sasahara.
U.S. Appl. No. 11/008,123, filed Dec. 10, 2004, Sasahara.
U.S. Appl. No. 11/008,124, filed Dec. 10, 2004, Terao et al.
U.S. Appl. No. 11/008,130, filed Dec. 10, 2004, Sasahara.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,149, filed Dec. 10, 2004, Sasahara.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,132, filed Oct. 6, 2005, 9 pages.
Y. Terao et al., Notice of Allowance and Fee(s) Due, U.S. Appl. No. 11/008,142, filed Jan. 5, 2007, 24 pages.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,349, filed May 2, 2005, 9 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,392, filed Sep. 15, 2006, 10 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., Notice of Allowance and Fee(s) Due, U.S. Appl. No. 11/085,244, filed Jul. 13, 2006, 10 pages.
Y. Terao et al., Notice of Allowance and Fee(s) Due, U.S. Appl. No. 11/085,247, filed Feb. 28, 2007, 14 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,131, filed Oct. 17, 2006, 15 pages.
Y. Terao et al., U.S. PTO Office Action, U.S. Appl. No. 11/008,132, filed Jun. 9, 2006, with attached Notice of Withdrawal from issue dated May 30, 2006, 11 pgs.
Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,145, filed Jun. 30, 2006, 6 pgs.
Y. Terao et al., U.S. PTO Office Action, U.S. Appl. No. 11/008,147, filed Jul. 7, 2006, 4 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al.; U.S. PTO Office Action, U.S. Appl. No. 11/008,230, filed Nov. 13, 2006, 17 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Jul. 21, 2006, 15 pgs.

Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,295, filed Jun. 23, 2006, 14 pgs.
Y. Terao et al., U.S. PTO Office Action, U.S. Appl. No. 11/008,299, May 5, 2006, 12 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,392, filed Apr. 26, 2006, 10 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,226, filed Jan. 29, 2007, 6 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Aug. 2, 2006, 15 pages.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,248, filed Oct. 24, 2006, 12 pages.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao et al., U.S. PTO Office Action, U.S. Appl. No. 11/085,625, filed Nov. 21, 2006, 13 pages.
Y. Terao et al., U.S. PTO Office, U.S. Appl. No. 11/008,290, filed Mar. 9, 2007, 8 pages.
Y. Terao et al., U.S. PTO Office, U.S. Appl. No. 11/008,294, filed Dec. 13, 2005, 9 pages.
Y. Terao et al., U.S. PTO Office, U.S. Appl. No. 11/008,299, filed Dec. 13, 2005, 9 pages.
Y. Terao et al., U.S. PTO Office, U.S. Appl. No. 11/008,349, filed Dec. 13, 2005, 9 pages.
Y. Terao et al., U.S. PTO Office, U.S. Appl. No. 11/085,240, filed Mar. 12, 2007, 15 pages.
Y. Terao et al., U.S. PTO Office, U.S. Appl. No. 11/085,242, filed Mar. 23, 2007, 20 pages.
Y. Terao et al., U.S. PTO Office, U.S. Appl. No. 11/085,248, filed Apr. 10, 2007, 12 pages.
Y. Terao et al., U.S. PTO Office, U.S. Appl. No. 11/085,257, filed Mar. 23, 2007, 23 pages.
Y. Terao et al., U.S. PTO Office, U.S. Appl. No. 11/085,264, filed Mar. 23, 2007, 21 pages.
Y. Terao, et al., Notice of Allowance and Fee(s) Due, U.S. Appl. No. 11/008,122, filed Jul. 26, 2006, 8 pgs.
Y. Terao, et al., Notice of Allowance and Fee(s) Due, U.S. Appl. No. 11/008,124, filed Sep. 30, 2005, 9 pages.
Y. Terao, et al., Notice of Allowance and Fee(s) Due, U.S. Appl. No. 11/008,222, filed Aug. 31, 2006, 12 pgs.
Y. Terao, et al., Notice of Allowance and Fee(s) Due, U.S. Appl. No. 11/008,257, filed Oct. 24, 2006, 11 pgs.
Y. Terao, et al., Notice of Allowance and Fee(s) Due, U.S. Appl. No. 11/008,299, filed Sep. 6, 2006, 9 pgs.
C. Iizuka et al., U.S. PTO Office Action, U.S. Appl. No. 11/085,251, filed Jun. 25, 2007, 28 pgs.
Y. Terao et al., Notice of Allowance and Fee(s) Due, U.S. Appl. No. 11/008,132, filed Jun. 1, 2007, 11 pgs.
Y. Terao et al., Notice of Allowance and Fee(s) Due, U.S. Appl. No. 11/008,294, filed Jun. 14, 2007, 6 pgs.
Y. Terao et al., Notice of Allowance and Fee(s) Due, U.S. Appl. No. 11/008,381, filed Jun. 29, 2007, 6 pgs.
Y. Terao et al., U.S. PTO Office Action, U.S. Appl. No. 11/085,242, filed Jul. 10, 2007, 9 pgs.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,625, filed Jul. 10, 2007, 11 pgs.
Y. Terao et al., Notice of Allowance and Fee(s) Due, U.S. Appl. No. 11/008,290, filed Aug. 2, 2007, 9 pages.
Y. Terao et al., Notice of Allowance and Fee(s) Due, U.S. Appl. No. 11/008,299, filed Jul. 23, 2007, 10 pages.
Y. Terao et al., Notice of Allowance and Fee(s) Due, U.S. Appl. No. 11/085,240, filed Jul. 24, 2007, 20 pages.
C. Iizuka et al., U.S. PTO Office, U.S. Appl. No. 11/085,251, filed Oct. 16, 2007, 10 pages.
Y. Terao et al., Notice of Allowance and Fee(s) Due, U.S. Appl. No. 11/085,242, filed Nov. 7, 2007, 10 pages.
Y. Terao et al., Notice of Allowance and Fee(s) Due, U.S. Appl. No. 11/085,257, filed Oct. 31, 2007, 8 pages.
Y. Terao et al., U.S. PTO Office, U.S. Appl. No. 11/085,250, filed Nov. 20, 2007, 13 pages.
Y. Terao et al., U.S. PTO Office, U.S. Appl. No. 11/085,625, filed Nov. 2, 2007, 11 pages.
Y. Terao et al., Notice of Allowance and Fee(s) Due, U.S. Appl. No. 11/008,131, filed Sep. 26, 2007, 12 pages.
Y. Terao et al., U.S. PTO Office Action, U.S. Appl. No. 11/008,199, filed Aug. 30, 2007, 18 pages.
Y. Terao et al., U.S. PTO Office Action, U.S. Appl. No. 11/008,224, filed Aug. 28, 2007, 8 pages.
Y. Terao et al., U.S. PTO Office Action, U.S. Appl. No. 11/008,248, filed Aug. 22, 2007, 8 pgs.
Y. Terao et al., Notice of Allowance and Fee(s) Due, U.S. Appl. No. 11/085,264, filed Sep. 12, 2007, 16 pages.
Y. Terao et al., U.S. PTO Office Action, U.S. Appl. No. 11/826,731, filed Sep. 13, 2007, 21 pages.
Y. Terao et al., Notice of Allowance and Fee(s) Due, U.S. Appl. No. 11/008,199, filed Jan. 16, 2008, 8 pages.
Y. Terao et al., U.S. PTO Office Action, U.S. Appl. No. 11/008,224, filed Dec. 14, 2007, 9 pages.
Y. Terao et al., U.S. PTO Office Action, U.S. Appl. No. 11/826,731, filed Jan. 14, 2008, 7 pages.
Y. Terao et al., Notice of Allowance and Fee(s) Due, U.S. Appl. No. 11/008,224, filed Sep. 11, 2008, 9 pages.
C. Iizuka et al., Notice of Allowance and Fee(s) Due, U.S. Appl. No. 11/085,251, filed Apr. 3, 2008, 8 pages.
Y. Terao et al., Notice of Allowance and Fee(s) Due, U.S. Appl. No. 11/008,248, filed Apr. 7, 2008, 11 pages.
Y. Terao et al., U.S. PTO Office Action, U.S. Appl. No. 11/008,224, filed Apr. 14, 2008, 7 pgs.

Y. Terao et al., U.S. PTO Office Action, U.S. Appl. No. 11/085,250, filed Apr. 10, 2008, 7 pgs.
Y. Terao et al., U.S. PTO Office Action, U.S. Appl. No. 11/976,140, filed Apr. 29, 2008, 27 pgs.
Y. Terao et al., Notice of Allowance and Fee(s) Due, U.S. Appl. No. 11/826,731, filed Jun. 13, 2008, 5 pages.
Y. Terao et al., U.S. PTO Office, U.S. Appl. No. 12/048,413, filed Jan. 12, 2009, 29 pages.
Y. Terao et al., Notice of Allowance and Fee(s) Due, U.S. Appl. No. 11/976,140, filed Oct. 17, 2008, 29 pages.
Y. Terao et al., Notice of Allowance and Fee(s) Due, U.S. Appl. No. 12/048,413, filed May 19, 2009, 4 pages.
Yasunobu Terao et al., U.S. PTO Office Action, U.S. Appl. No. 12/252,142, Nov. 2, 2009, 25 pages.

* cited by examiner

*Primary Examiner*—Patrick H Mackey
*Assistant Examiner*—Jeremy Severson
(74) *Attorney, Agent, or Firm*—Foley & Lardner LLP

(57) ABSTRACT

A sheet post-process apparatus includes a waiting tray and a processing tray. The waiting tray is provided in the middle of a conveying path and makes standby sheets in the case where a post-process is required. The processing tray has a function which causes the sheets made standby on the waiting sheet to be dropped by self-weight. With this function, the processing tray receives the sheets moved to be dropped and the sheets conveyed from the conveying path without intervening the waiting tray, before carrying out the post-process. Sheet bundles formed on the processing tray are stacked on a storage tray by a sheet conveying mechanism after they have been post-processed.

6 Claims, 11 Drawing Sheets

SHEET POST-PROCESS APPARATUS

CROSS-REFERENCE TO RELATED APPLICATIONS

The present application is a continuation of U.S. application Ser. No. 11/008,567, filed Dec. 10, 2004, the entire contents of which is incorporated herein by reference.

BACKGROUND OF THE INVENTION

1. Field of the Invention

The present invention relates to a sheet post-process apparatus, such as a finisher, which is designed for installation at the outlet side of a multi-function peripheral (MFP).

2. Description of the Related Art

A finisher is known, which bundles a plurality of sheets by an MFP (Multi-Function Peripheral) and staples them. In this finisher, the sheets conveyed from the MFP are sequentially conveyed to a processing tray, the conveyed sheets are stapled, and the stapled sheets are conveyed to a storage tray.

This finisher has a second tray for temporarily housing sheets ejected from an image forming apparatus, and, when ejection of the sheet-bundle from a first tray completes, saving them at a predetermined position, and dropping the temporarily housed sheets onto the first tray. However, in this case, there is a need for providing a mechanism for saving the second tray (refer to Jpn. Pat. Appln. KOKAI Publication No. 2001-89009).

Thus, equipment downsizing has been sufficiently achieved.

BRIEF SUMMARY OF THE INVENTION

An object of the present invention is to provide a small sized sheet post-process apparatus.

According to an aspect of the present invention, there is provided a sheet post-process apparatus comprising: a plurality of rollers which receive and convey sheets conveyed from an MFP main body; a waiting tray which is provided in the course of a conveying path, and makes standby the sheets conveyed from the rollers in the case where a post-process is required; a conveying mechanism which causes the sheets made standby on the waiting tray to be dropped and moved by self-weight; a processing tray which receives the sheets dropped and moved from the waiting tray and the sheets conveyed from the conveying path without intervening the waiting tray, before carrying out a post-process; a post-process mechanism which carries out a post-process on a bundle of sheets aligned on the processing tray; a sheet-conveying mechanism which conveys the post-processed bundle of sheets from the processing tray; and a storage tray which stacks the bundle of sheets conveyed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of this invention will be described, with reference to the accompanying drawings.

Figure 1:
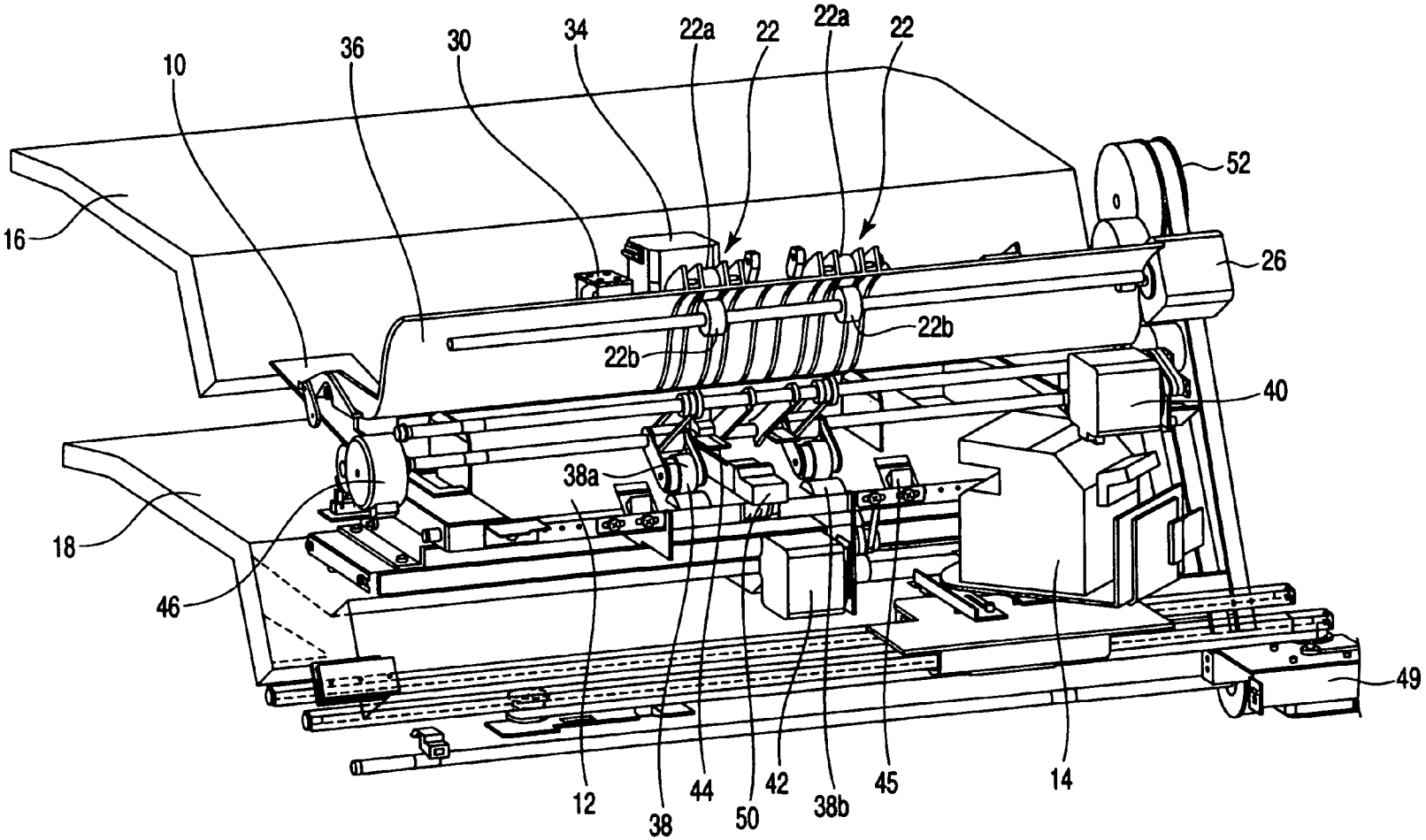
FIG. 1 is a perspective view of a sheet post-process apparatus according to an embodiment of the present invention.
Figure 2:
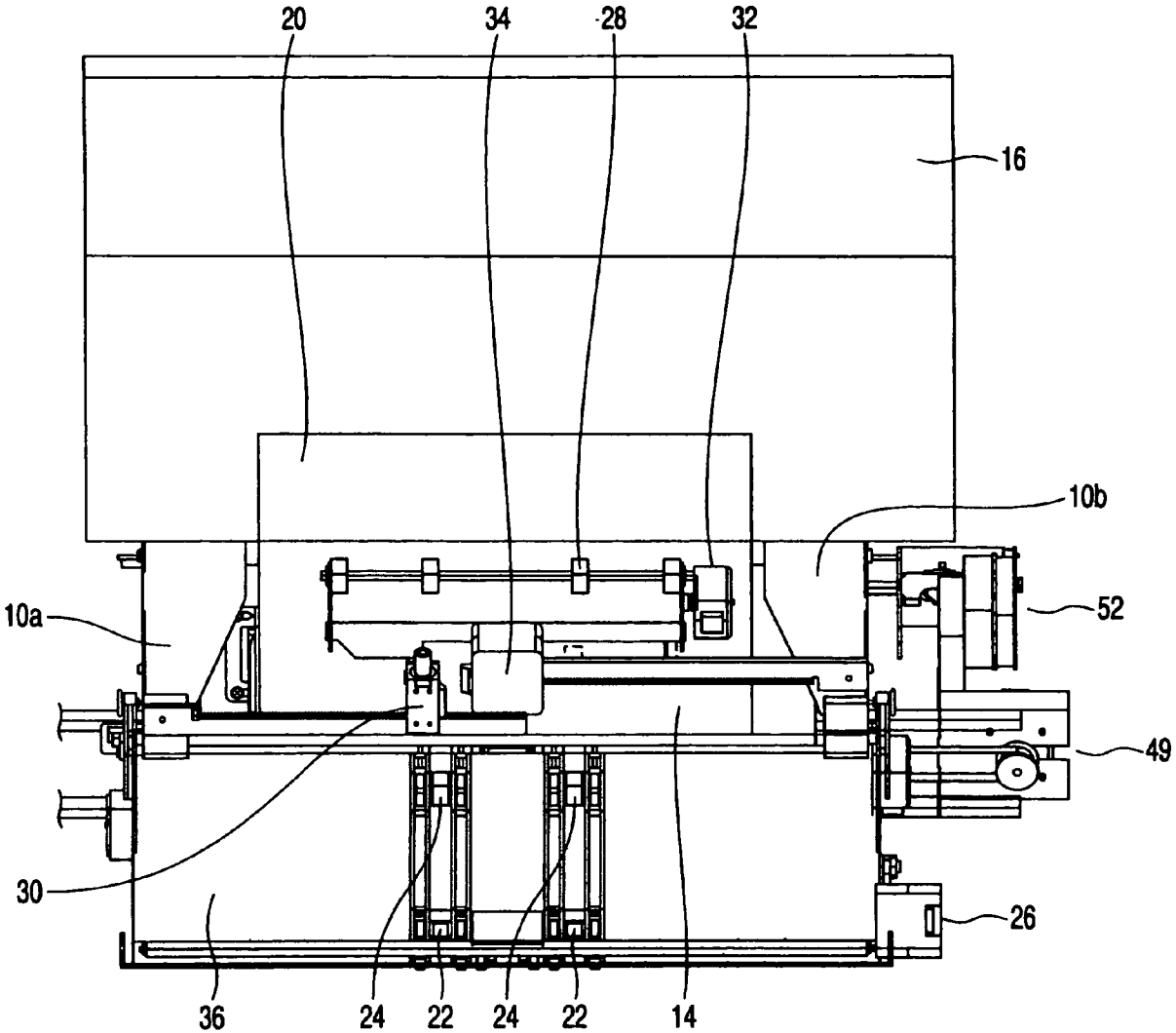
FIG. 2 is a top view of the sheet post-process apparatus in the same embodiment.

FIG. 1 is a perspective view of a sheet post-process apparatus according to this invention. FIG. 2 is a top view of the sheet post-process apparatus of the invention. As is shown in FIG. 1, the sheet post-process apparatus comprises a waiting tray 10, a processing tray 12, a stapler 14, a first storage tray 16, and a second storage tray 18.

A pair of input rollers 22 receive a sheet 20 supplied from an MFP and conveys the sheet 20 to a pair of sheet-feeding rollers 24. The sheet-feeding rollers 24 convey the sheet 20 to the waiting tray 10. An input-roller motor 26 drives the input rollers 22.

The input rollers 22 include an upper input roller 22*a* and a lower input roller 22*b*. Similarly, the sheet-feeding rollers 24 include an upper sheet-feeding roller and a lower sheet-feeding roller.

The waiting tray 10 is composed of a pair of two tray parts 10*a* and 10*b* which can be move to the left and right, and receives a sheet in a state in which the waiting tray parts 10*a* and 10*b* are closed. A waiting tray roller 28 is provided for carrying out alignment of sheets in this state. The waiting tray roller 28 can move vertically, and its control is executed by a waiting tray roller drive source 30. In addition, rotation of the waiting tray roller 28 is carried out by a waiting tray roller motor 32.

Figure 3:
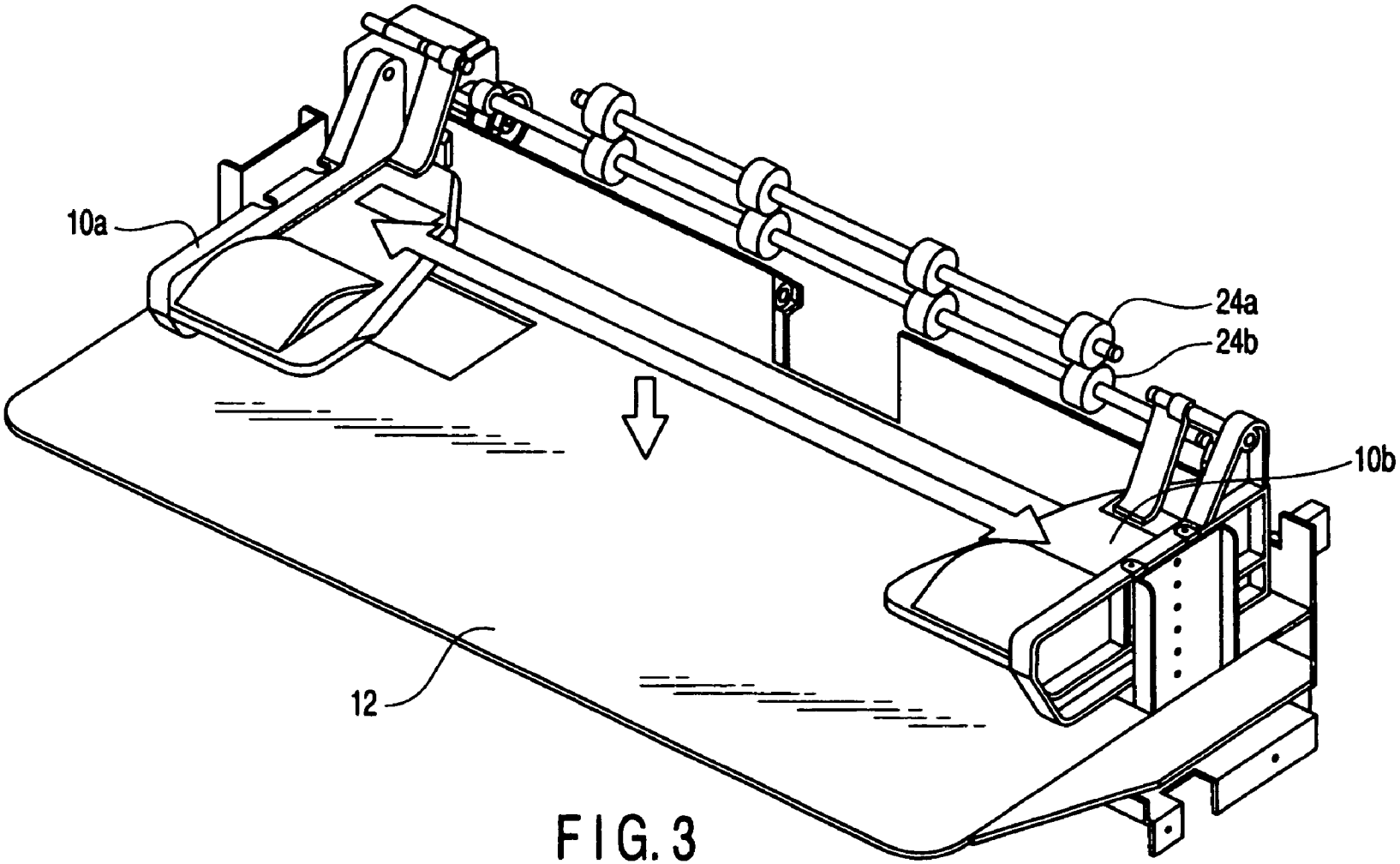
FIG. 3 is a view illustrating an operation of a waiting tray in the same embodiment.

As shown in FIG. 3, a predetermined number of sheets are stacked on the waiting tray 10, the waiting tray parts 10*a* and 10*b* are opened by a waiting-tray motor 34, and the sheets 20 are dropped onto the processing tray 12 by self-weight. This operation is referred to as active drop.

The processing tray 12 is positioned vertically downwardly of the waiting tray 10, and is allocated so as to be positioned so as to have an overlap portion with respect to a direction orthogonal to the vertical direction.

The size relevant to a widthwise direction of the sheets 20 on the waiting tray 10 is smaller than the width of the sheets 20, and the size relevant to a widthwise direction of the sheets 20 on the processing tray 12 is smaller than the width of the sheets 20. In addition, the sheets 20 moved to be dropped from the waiting tray 10 are configured so as to be stacked across the processing tray 12 and the storage tray 16. With this configuration, the downsizing in the widthwise direction of the sheet post-process apparatus is achieved.

A paper path is provided to guide the sheets conveyed from the MFP to the waiting tray 10 and processing tray 12. This paper path is composed of a paper path ceiling 36.

Figure 4:
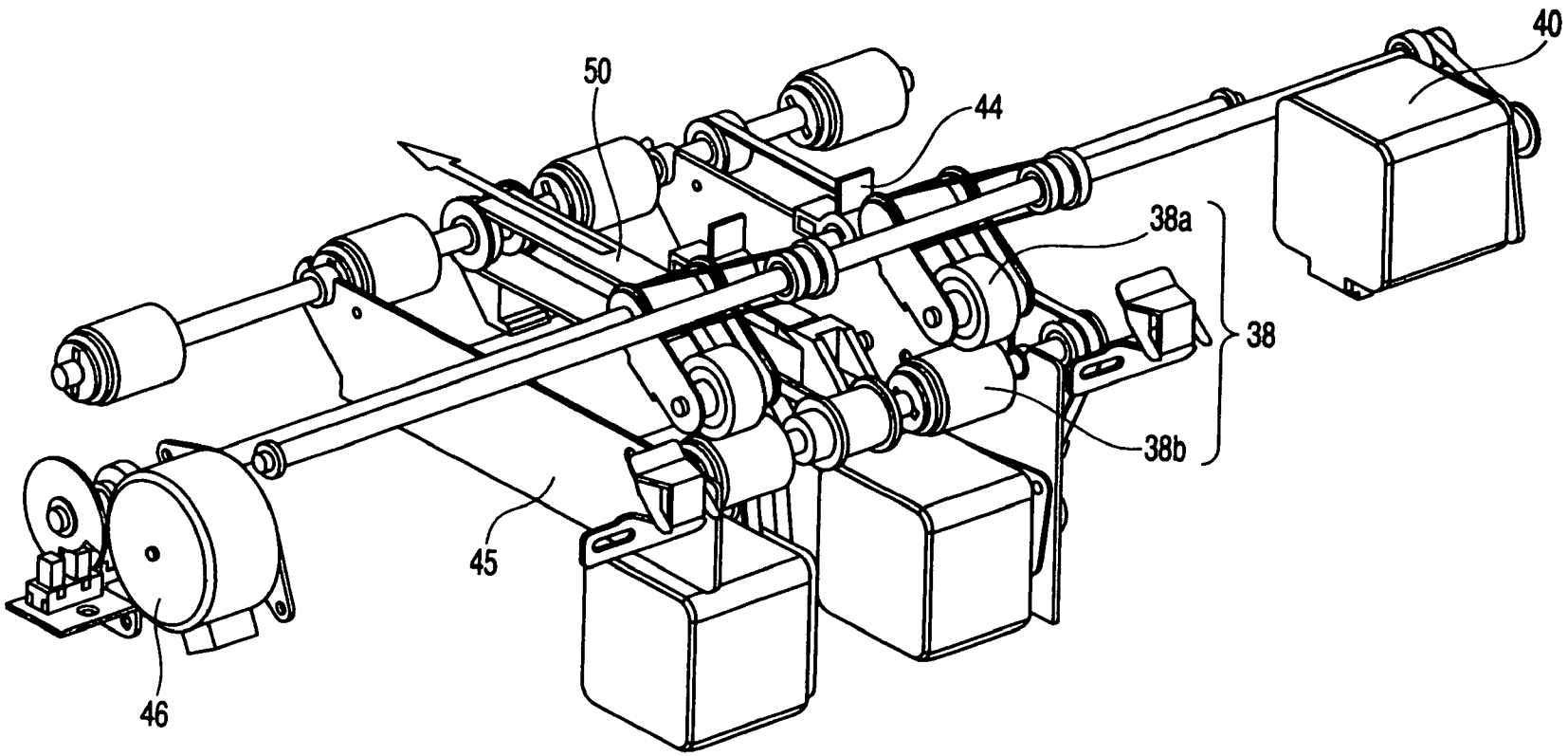
FIG. 4 is a view illustrating longitudinal alignment of the sheet post-process apparatus and a sheet alignment conveying mechanism in the same embodiment.

The sheets conveyed onto the processing tray 12 are subjected to longitudinal and transverse alignments. Longitudinal alignment is made by a longitudinal-alignment mechanism 38, as shown in FIG. 4. More precisely, an upper longitudinal-alignment motor 40 drives upper longitudinal-alignment rollers 38*a* and a lower longitudinal-alignment motor 42 drives lower longitudinal-alignment rollers 38*b*, thereby aligning the sheet with a stopper 45 as a reference. Paddles 44 are provided to facilitate the longitudinal alignment. A paddle motor 46 drives the paddles 44.

Figure 5:
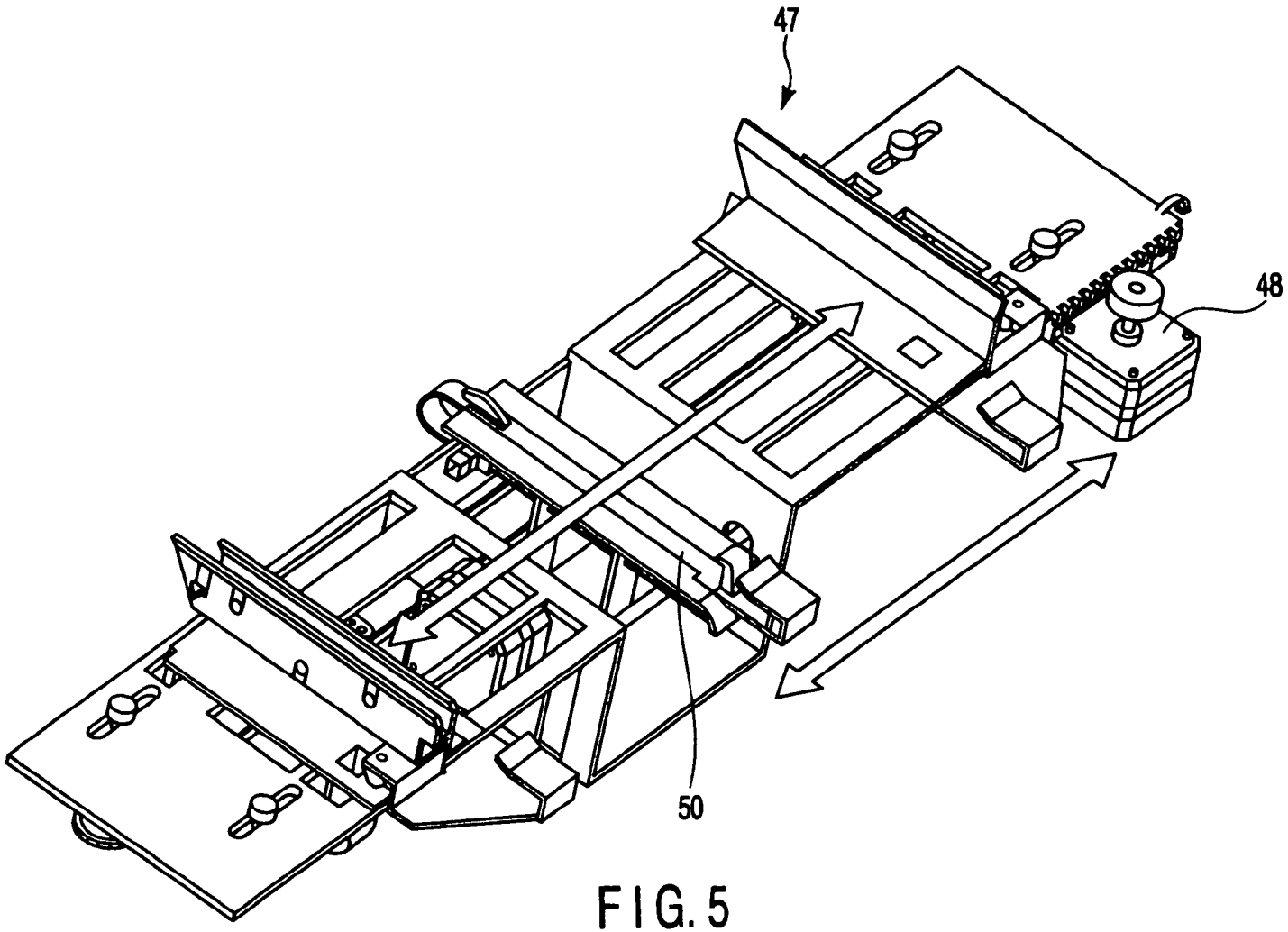
FIG. 5 is a view illustrating a transverse alignment mechanism of the sheet post-processing apparatus in the same embodiment.
Figure 6:
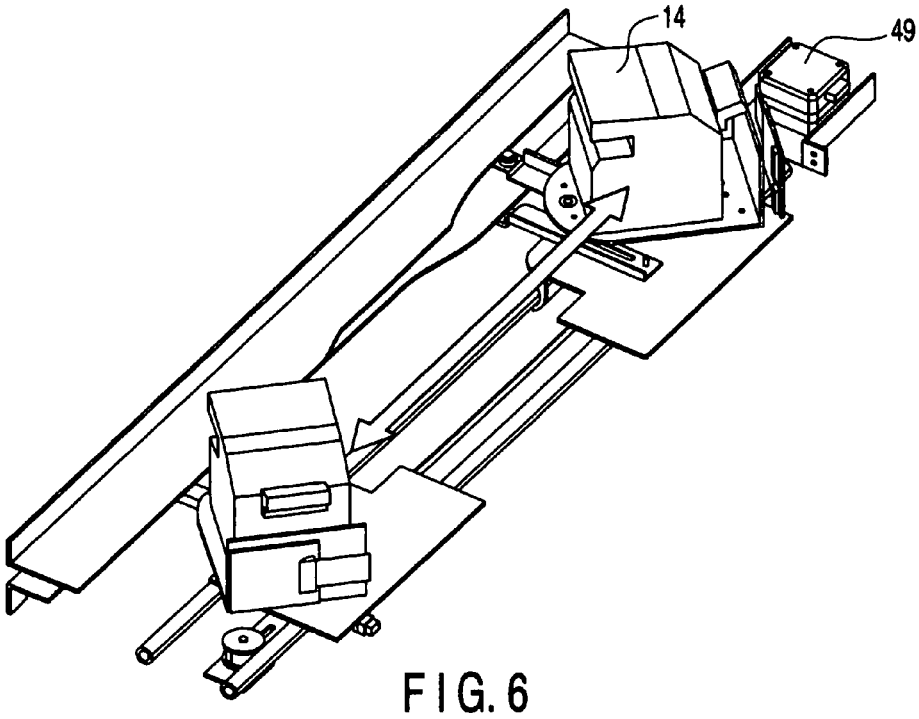
FIG. 6 is a view illustrating an operation of a stapler of the sheet post-process apparatus in the same embodiment.

Transverse alignment is executed by means of a transverse-alignment mechanism 47 and a transverse-alignment motor 48, as shown in FIG. 5. When a predetermined number of sheets are aligned and stacked on the processing tray 12, staple processing is carried out by the stapler 14. As shown in FIG. 6, the stapler is positioned by a staple-driving unit 49, and staple processing is controlled.

The stapled sheet bundles are conveyed to the storage tray 16 by a conveying mechanism 50. Selection of the storage tray 16 or storage tray 18 is made by vertically moving the storage tray 16 and 18 by means of a storage tray driving unit 52.

An operation of the sheet post-process apparatus according to this invention will be described with reference to FIGS. 7 to 18.

Figure 7:
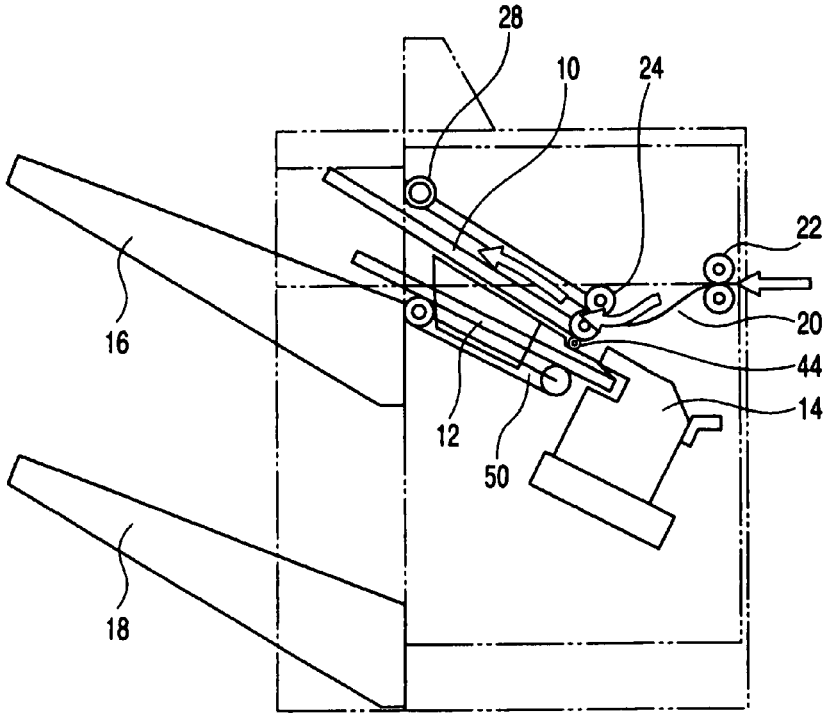
FIG. 7 is a view illustrating a flow of a first sheet of paper between an inlet roller and a sheet-feeding roller in the sheet post-process apparatus in the same embodiment.

As shown in FIG. 7, the sheet 20 conveyed from the MFP is moved to the sheet-feeding rollers 24 via the input rollers 22 in the direction indicated by the arrow.

Figure 8:
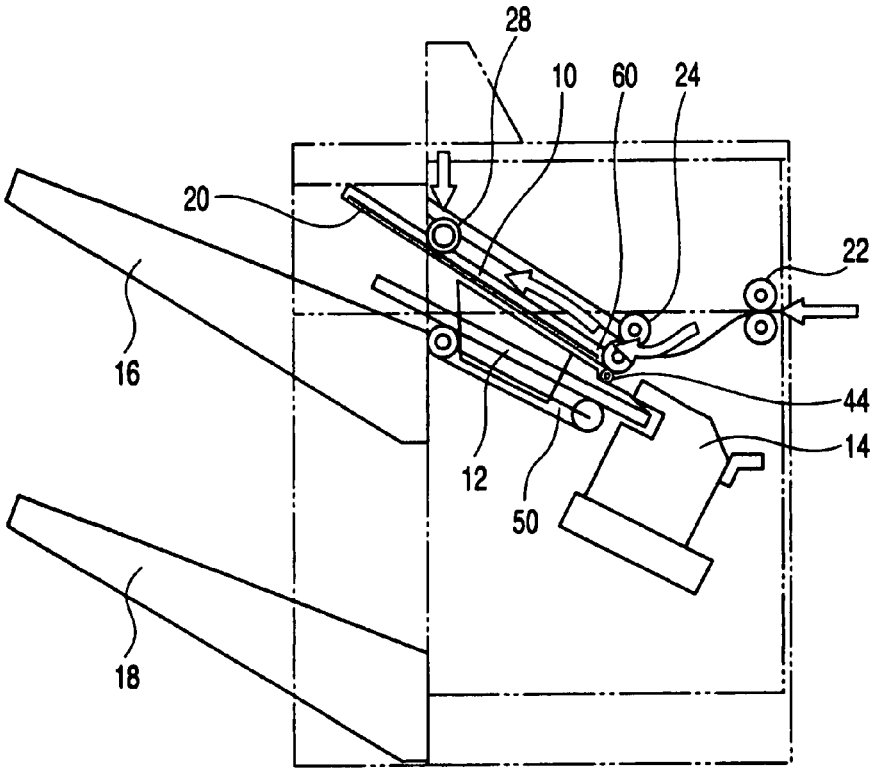
FIG. 8 is a view illustrating a flow of a first sheet of paper between the sheet-feeding roller and the waiting tray in the sheet post-process apparatus in the same embodiment.

Next, as shown in FIG. 8, a first sheet is stacked onto the waiting tray 10 through the sheet-feeding roller 24. At this time, the waiting-tray rollers 28 move down in the direction indicated by the arrow, and align the trailing edge of the first sheet 20 at the rear (i.e., upstream) end 60 of the waiting tray 10.

Figure 9:
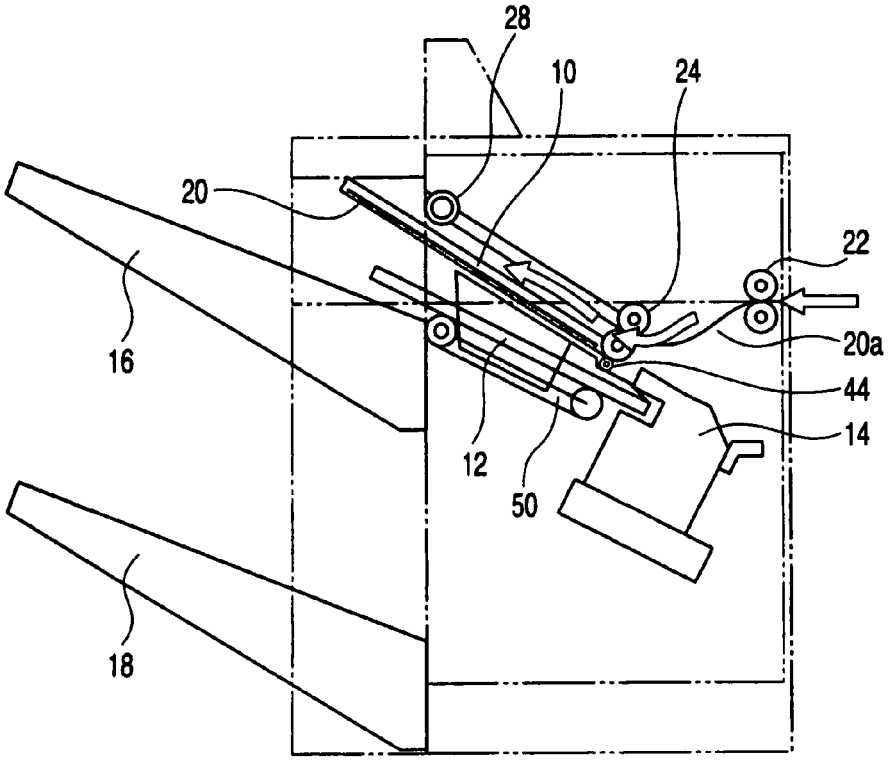
FIG. 9 is a view illustrating a flow of a second sheet of paper between the sheet-feeding roller and the waiting tray in the sheet post-process apparatus in the same embodiment.

Next, as shown in FIG. 9, the waiting-tray rollers 28 move up, and are ready to receive the second sheet 20*a*.

Figure 10:
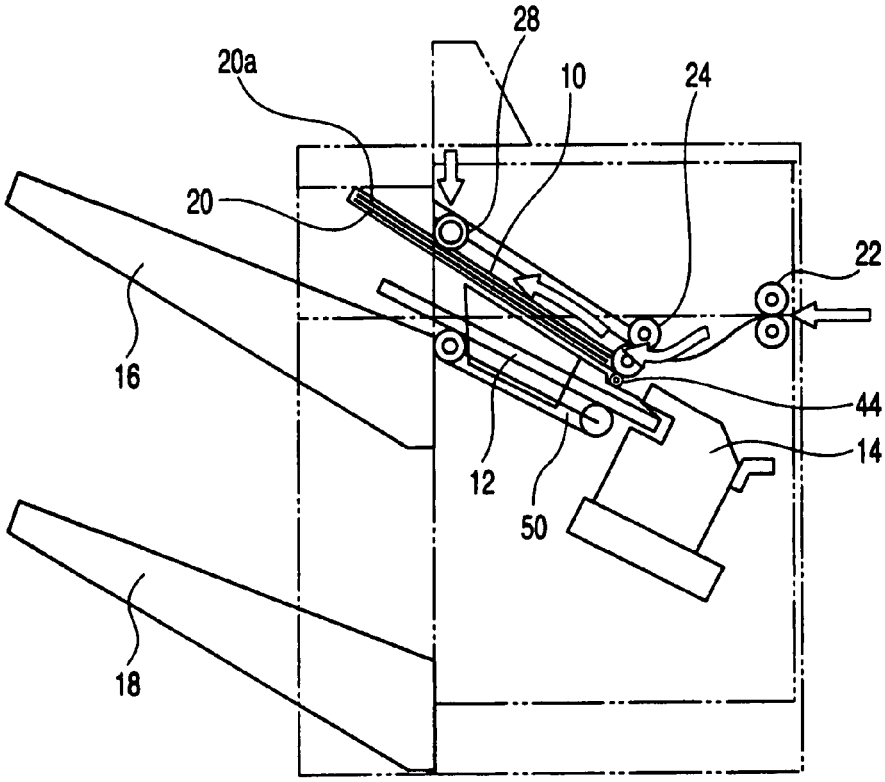
FIG. 10 is a view illustrating an operation of a waiting tray roller in the sheet post-process apparatus in the same embodiment.

When the above receiving is ready, as shown in FIG. 10, the second sheet 20 is conveyed to the waiting tray 10. The waiting-tray rollers 28 move down, thereby aligning the trailing edge of the second sheet 20*a* at the rear end 60 of the waiting tray 10. Thus, a bundle 20*b* of two sheets 20 and 20*a* is formed in the waiting tray 10.

Figure 11:
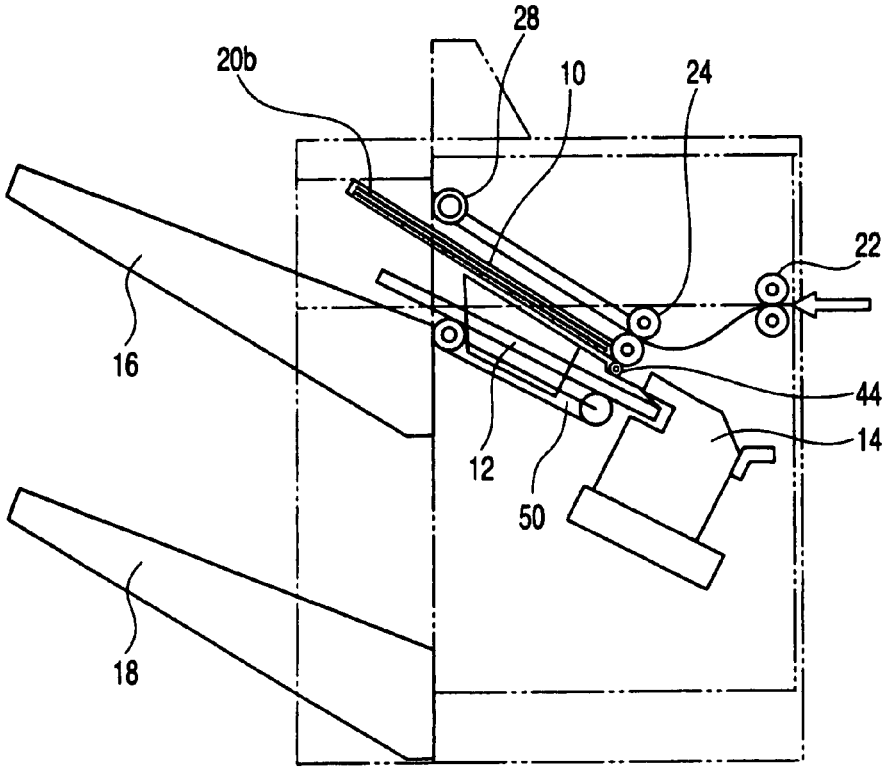
FIG. 11 is a view illustrating an operation of the waiting tray roller in the sheet post-process apparatus in the same embodiment.

Next, as is shown FIG. 11, the waiting-tray rollers 28 move upwards. Further, the waiting-tray parts 10*a* and 10*b* open as shown in FIG. 3. The active drop is executed as shown in FIG. 12, and the bundle 20*b* is moved to be dropped onto the processing tray 12.

Figure 12:
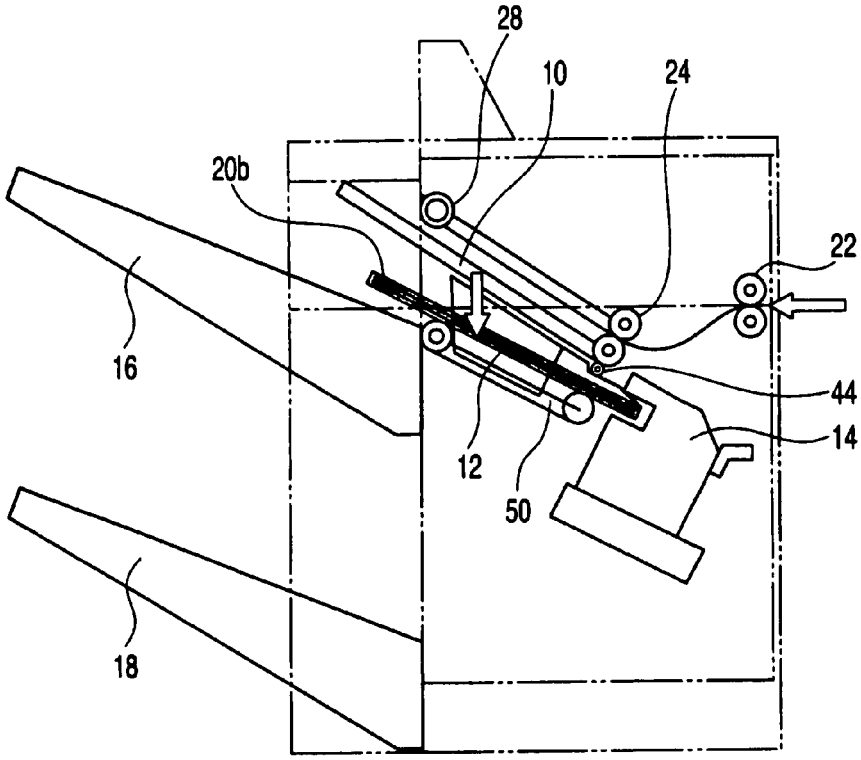
FIG. 12 is a view illustrating an operation of active drop in the sheet post-process apparatus in the same embodiment.

At this time, as shown in FIG. 12, the waiting tray 10 is positioned vertically upwardly of the processing tray 12 and is allocated to be positioned so as to have an overlap portion with respect to a direction orthogonal to the vertical direction. Thus, when the sheet bundle 20*b* made standby on the waiting tray 10 is moved to be dropped onto the processing tray 12. In this manner, the sheet bundle 20*b* is configured so as to be dropped and moved. Thus, in the case where a roller or the like is used as conveying means, a conventional member which has been believed as a technique can be eliminated or simplified, thus making it possible to help achieve an inexpensive structure. In addition, as has been described above, there is provided a structure of making the sheet bundle 20*b* standby on the waiting tray 10, opening the waiting tray parts 10*a* and 10*b*, and dropping the sheet bundle 20*b* onto the processing tray 12. Thus, the downsizing of the sheet post-process apparatus can be achieved.

Figure 13:
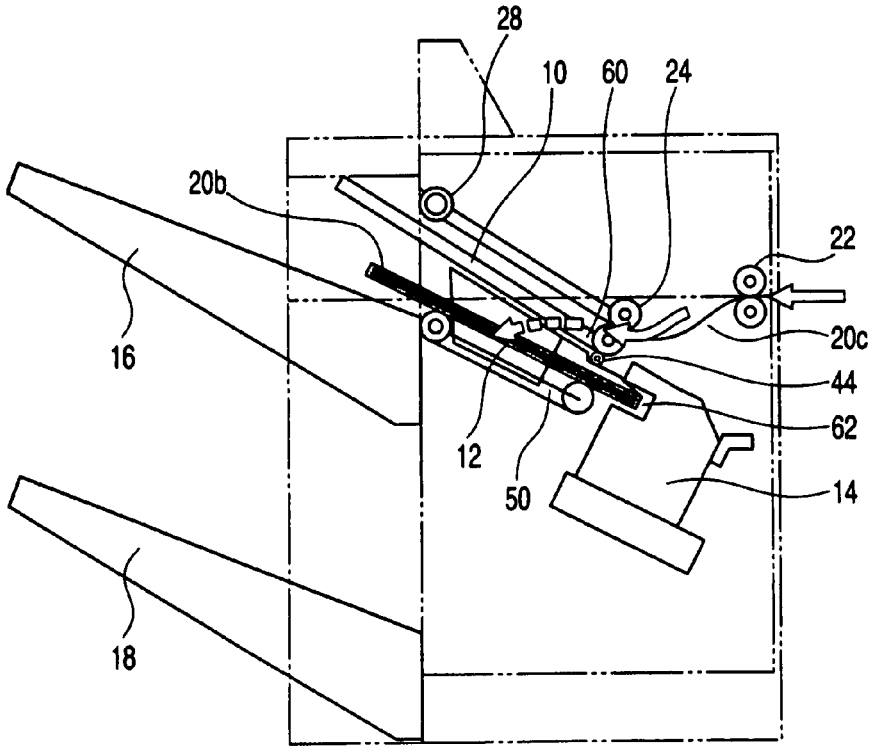
FIG. 13 is a view illustrating a flow of a third sheet of paper in the sheet post-process apparatus in the same embodiment.

Then, the third and subsequent sheets 20*c* are conveyed from the sheet-feeding roller 24 directly to the processing tray 12 without intervening the waiting tray 10, as shown in FIG. 13. The conveyed sheets are stacked onto the two sheet bundles 20*b*, and a predetermined number of sheet bundles 21 are formed. At this time, the longitudinal alignment mechanism (longitudinal-alignment rollers) 38 and vertical alignment mechanism 47 function, whereby longitudinal and transverse sheet alignments are executed.

Figure 14:
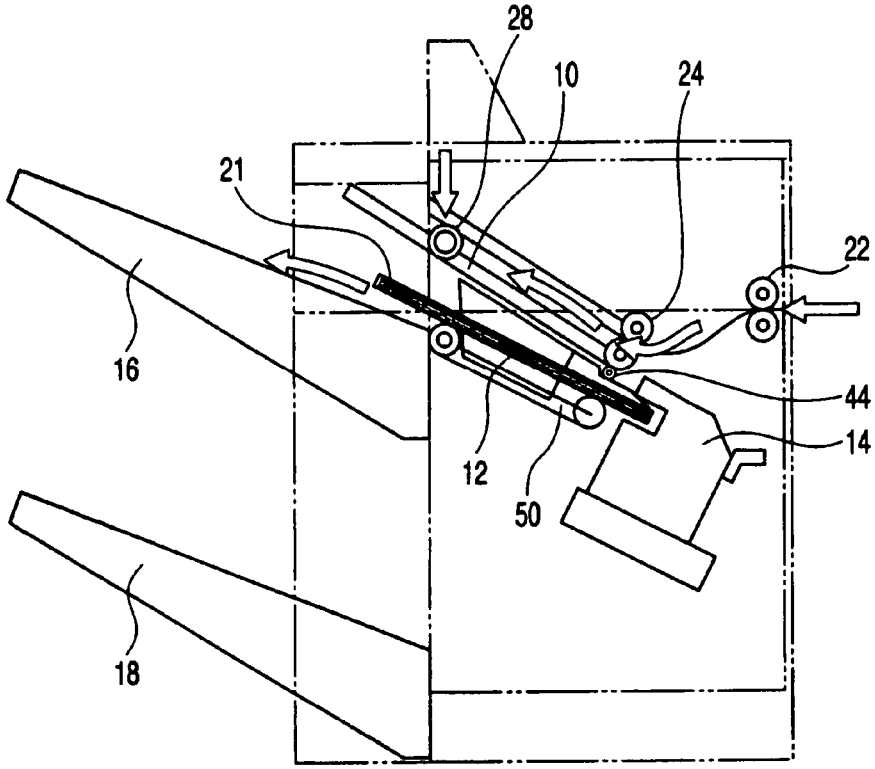
FIG. 14 is a view illustrating an operation of the stapler in the sheet post-process apparatus in the same embodiment.
Figure 15:
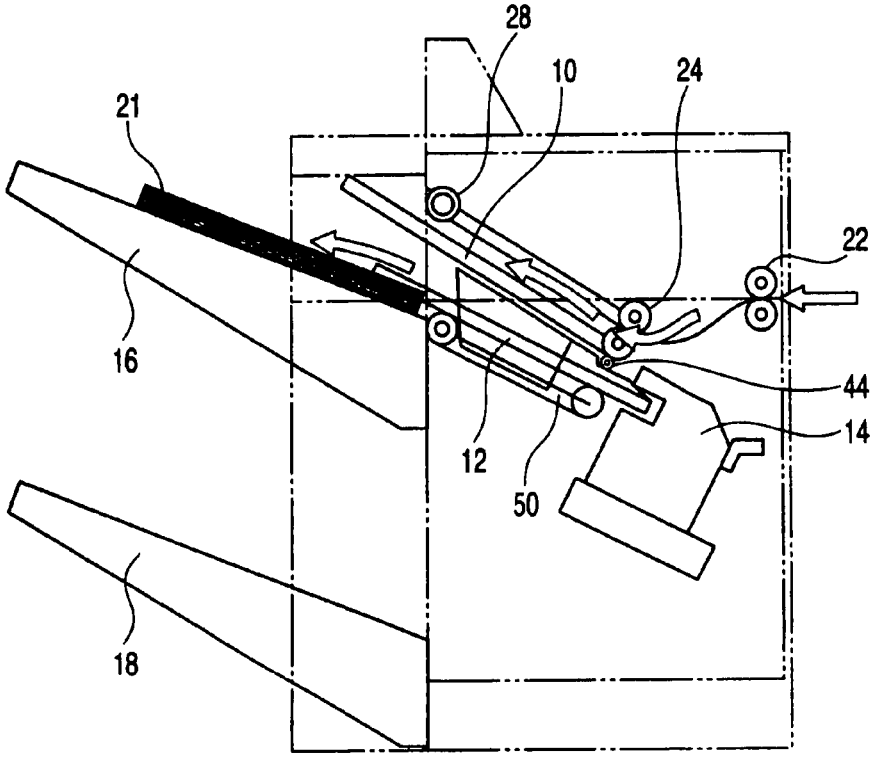
FIG. 15 is a view of illustrating a flow of a sheet-bundle between a processing tray and a storage tray in the sheet post-process apparatus in the same embodiment.

Next, as shown in FIG. 14, the sheet bundle 21 is stapled by the stapler 14. Then, as shown in FIG. 15, the sheet bundle 20 is conveyed to the storage tray 16 by the conveying mechanism 50, and a post-process is terminated.

Figure 16:
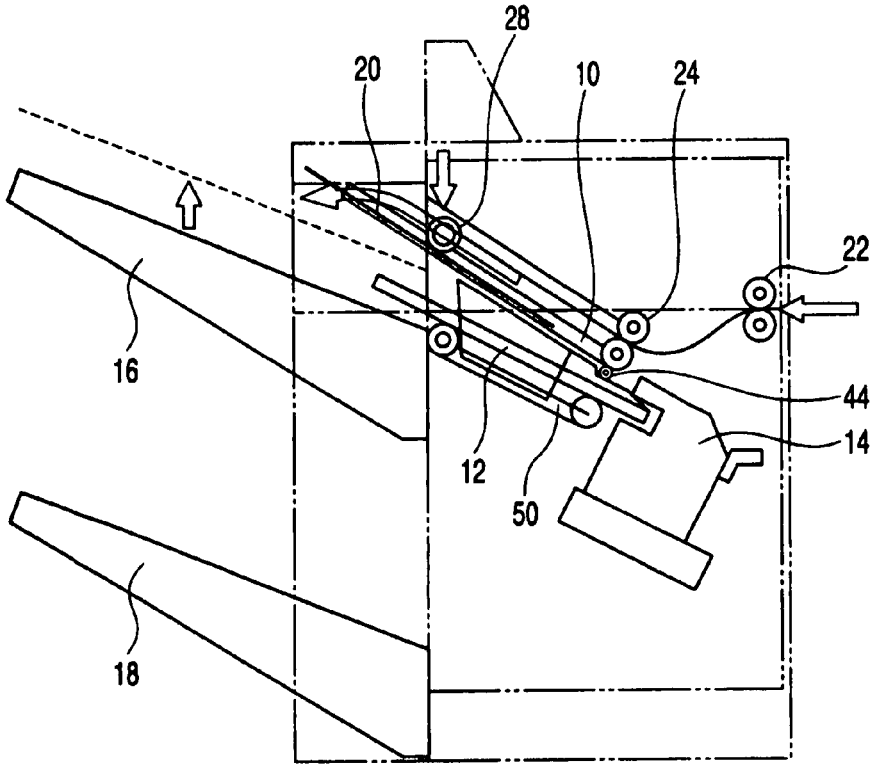
FIG. 16 is a view illustrating a flow when sheets are directly ejected from the waiting tray to the storage tray in the sheet post-process apparatus in the same embodiment.
Figure 17:
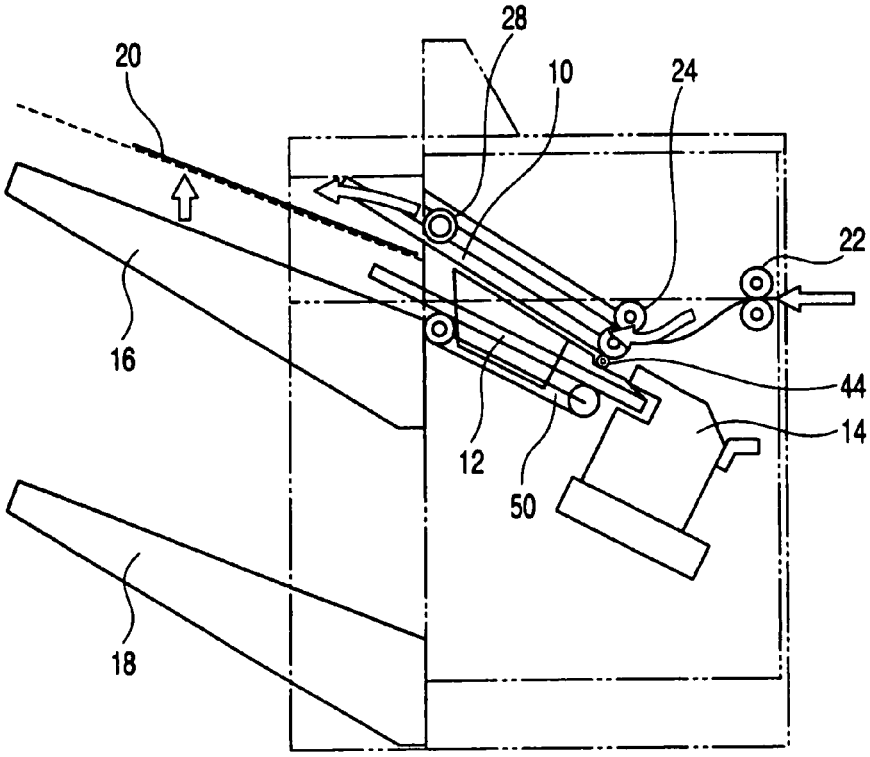
FIG. 17 is a view illustrating an operation for changing a position of the storage tray in the sheet post-process apparatus in the same embodiment.

In the case where no post-process is required, the sheets are ejected from the waiting tray 10 directly to the storage tray 16 without intervening the processing tray 12, as shown in FIGS. 16 and 17. As is shown in FIG. 16, the sheets supplied from the MFP are sequentially conveyed to the first storage tray 16 via the input rollers 22, sheet-feeding rollers 24 and waiting tray 10. The waiting-tray rollers 28 move down, serving to convey the sheets 20. As depicted in FIG. 17, the first storage tray 16 is slightly lifted by the storage tray driving unit 52, and receives the sheets conveyed from the waiting tray 10.

The invention disclosed herein is not limited to the above-described embodiment. Rather, the invention encompasses any apparatus and/or system that integrates or combines any or all of the features disclosed in the applications listed in Schedule A herein. As noted on page 1, all of those applications are incorporated herein by reference in their entirety.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

SCHEDULE A

| Japanese Priority Application No. | Japanese Priority Filing Date | Corresponding U.S. Pat. Application No. | Corresponding U.S. Application Filing Date | Corresponding U.S. Application Attorney Docket Publication No. | Corresponding U.S. Application Title |
|---|---|---|---|---|---|
| 2004-281772 | Sep. 28, 2004 | US-2006-0067769-A1 | Dec. 10, 2004 | 016907-1771 | Sheet Post-Process Apparatus And Waiting Tray |
| 2004-282209 | Sep. 28, 2004 | US-2006-0066029-A1 | Dec. 10, 2004 | 016907-1772 | Sheet Post-Process Apparatus |
| 2004-282208 | Sep. 28, 2004 | US-2006-0066026-A1 | Dec. 10, 2004 | 016907-1773 | Sheet Post-Process Apparatus |
| 2004-282207 | Sep. 28, 2004 | US-2006-0066025-A1 | Dec. 10, 2004 | 016907-1774 | Sheet Post-Process Apparatus |
| 2004-282206 | Sep. 28, 2004 | US-2006-0066030-A1 | Dec. 10, 2004 | 016907-1775 | Sheet Post-Process Apparatus |
| 2004-281771 | Sep. 28, 2004 | US-2006-0066032-A1 | Dec. 10, 2004 | 016907-1776 | Sheet Post-Process Apparatus |
| 2004-281770 | Sep. 28, 2004 | US-2006-0066027-A1 | Dec. 10, 2004 | 016907-1777 | Sheet Post-Process Apparatus |
| 2004-281769 | Sep. 28, 2004 | US-2006-0067768-A1 | Dec. 10, 2004 | 016907-1778 | Sheet Post-Process Apparatus |
| 2004-282205 | Sep. 28, 2004 | US-2006-0066023-A1 | Dec. 10, 2004 | 016907-1779 | Sheet Post-Process Apparatus |
| 2004-282204 | Sep. 28, 2004 | US-2006-0066028-A1 | Dec. 10, 2004 | 016907-1780 | Sheet Post-Process Apparatus |
| 2004-282203 | Sep. 28, 2004 | US-2006-0066031-A1 | Dec. 10, 2004 | 016907-1781 | Sheet Post-Process Apparatus |
| 2004-281780 | Sep. 28, 2004 | US-2006-0066831-A1 | Dec. 10, 2004 | 016907-1782 | Sheet Post-Process Apparatus And Processing Tray |
| 2004-282210 | Sep. 28, 2004 | US-2006-0066024-A1 | Dec. 10, 2004 | 016907-1783 | Sheet Post-Process Apparatus |
| 2004-281773 | Sep. 28, 2004 | US-2006-0067770-A1 | Dec. 10, 2004 | 016907-1784 | Sheet Post-Process Apparatus And Waiting Tray |
| 2004-281774 | Sep. 28, 2004 | US-2006-0067767-A1 | Dec. 10, 2004 | 016907-1785 | Sheet Post-Process Apparatus And Waiting Tray |
| 2004-282211 | Sep. 28, 2004 | US-2006-0067771-A1 | Dec. 10, 2004 | 016907-1786 | Sheet Post-Process Apparatus And Waiting Tray |
| 2004-282212 | Sep. 28, 2004 | US-2006-0067773-A1 | Dec. 10, 2004 | 016907-1787 | Sheet Post-Process Apparatus |
| 2004-281775 | Sep. 28, 2004 | US-2006-0067772-A1 | Dec. 10, 2004 | 016907-1788 | Sheet Post-Process Apparatus |
| 2004-281776 | Sep. 28, 2004 | US-2006-0067763-A1 | Dec. 10, 2004 | 016907-1789 | Sheet Post-Process Apparatus And Waiting Tray |
| 2004-281777 | Sep. 28, 2004 | US-2006-0067766-A1 | Dec. 10, 2004 | 016907-1790 | Sheet Post-Process Apparatus And Waiting Tray |
| 2004-281778 | Sep. 28, 2004 | US-2006-0067764-A1 | Dec. 10, 2004 | 016907-1791 | Sheet Post-Process Apparatus And Waiting Tray |
| 2004-281779 | Sep. 28, 2004 | US-2006-0067762-A1 | Dec. 10, 2004 | 016907-1792 | Sheet Post-Process Apparatus And Waiting Tray |
| 2004-281781 | Sep. 28, 2004 | US-2006-0069881-A1 | Dec. 10, 2004 | 016907-1793 | Shared Memory Access Control Apparatus |
| 2004-281782 | Sep. 28, 2004 | US-2006-0067319-A1 | Dec. 10, 2004 | 016907-1794 | Communication System And Master Apparatus |
| 2004-281783 | Sep. 28, 2004 | US-2006-0070064-A1 | Dec. 10, 2004 | 016907-1795 | Computer Apparatus On Which Download Board Can Be Mounted |
| 2004-281784 | Sep. 28, 2004 | US-2006-0066021-A1 | Dec. 10, 2004 | 016907-1796 | Sheet Post-Process Apparatus |
| 2004-282213 | Sep. 28, 2004 | US-2006-0067765-A1 | Dec. 10, 2004 | 016907-1797 | Sheet Post-Process Apparatus And Waiting Tray |
| 2004-282214 | Sep. 28, 2004 | US-2006-0066022-A1 | Dec. 10, 2004 | 016907-1798 | Sheet Post-Process Apparatus |

What is claimed is:

1. A sheet loading apparatus, comprising:

a pair of waiting tray parts which support sheets conveyed along a sheet conveying direction, and arranged at an interval in a transverse direction orthogonal to the sheet conveying direction;

an adjuster configured to adjust the interval, the interval being set to a first width smaller than a width of the sheets orthogonal to the sheet conveying direction for loading the sheets, and being set to a second width larger than the width of the sheets;

a strike down member configured to apply a downward force on the sheets to make the sheets bend and fall down from the pair of waiting tray parts;

a receiving tray configured to receive the sheets fallen from the pair of waiting tray parts;

a sheet discharger configured to discharge the bundle of sheets to which a post-process has been performed from the receiving tray;

a distal end upper face retainer configured to retain a distal end upper face of the sheets on the pair of waiting tray parts when the interval widens from the first width to the second width; and a rotary shaft configured to be allocated in association with the distal end face in the sheet conveying direction, mount the distal end upper face retainer and the strike down member coaxially, and rotate the distal end upper face retainer and the strike down member, wherein when the sheet discharger is projected on a horizontal plane, a discharge direction of the sheet discharger is parallel to the sheet conveying direction.

2. The apparatus of claim 1, further comprising an aligner configured to align the sheets on the receiving tray to form a bundle of sheets.

3. The apparatus of claim 2, further comprising a post-processor configured to perform a post-process on the bundle of sheets aligned by the aligner.

4. The apparatus of claim 1, further comprising a storage tray configured to load the bundle of sheets discharged by the sheet discharger, wherein the storage tray is positioned downstream of the receiving tray in the sheet conveying direction.

5. The apparatus of claim 1, wherein the pair of waiting tray parts are formed so that a width of the interval formed between the pair of waiting tray parts is larger at a distal end side than a proximal end side in the sheet conveying direction.

6. The apparatus of claim 1, wherein the receiving tray has a rear end positioned upstream of a rear end of the pair of waiting tray parts in the sheet conveying direction.

* * * * *